US006648590B2

(12) United States Patent
Huang et al.

(10) Patent No.: US 6,648,590 B2
(45) Date of Patent: Nov. 18, 2003

(54) PARALLEL FAN

(75) Inventors: Wen-Shi Huang, Taoyuan Hsien (TW); Kuo-Cheng Lin, Taoyuan (TW); Wei-Chen Kuo, Sanchung (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 0 days.

(21) Appl. No.: 09/798,573

(22) Filed: Mar. 2, 2001

(65) Prior Publication Data

US 2001/0028842 A1 Oct. 11, 2001

(30) Foreign Application Priority Data

Apr. 10, 2000 (TW) ..... 89205727 U

(51) Int. Cl.[7] ..... F04D 23/00
(52) U.S. Cl. ..... 415/53.1; 415/60; 415/206
(58) Field of Search ..... 415/53.1, 213.1, 415/224, 203, 206, 199.1, 220, 60, 61, 214.1, 175, 176, 177, 178; 416/244 R, 198 R

(56) References Cited

U.S. PATENT DOCUMENTS

| | | | | | |
|---|---|---|---|---|---|
| 4,767,262 | A | * | 8/1988 | Simon | 415/119 |
| 4,851,965 | A | * | 7/1989 | Gabuzda et al. | 361/383 |
| 5,772,500 | A | * | 6/1998 | Harvey et al. | 454/184 |
| 5,810,554 | A | * | 9/1998 | Yokozawa et al. | 415/176 |
| 6,030,173 | A | * | 2/2000 | Bacchiocchi | 415/98 |
| 6,077,037 | A | * | 6/2000 | Schmidt | 415/213.1 |

* cited by examiner

*Primary Examiner*—Edward K. Look
*Assistant Examiner*—J. M. McAleenan
(74) *Attorney, Agent, or Firm*—Steinberg & Raskin, P.C.

(57) ABSTRACT

The present invention relates to a parallel fan. The parallel fan includes an integrally formed fan frame having plural pairs of locating windows and a plurality of fans being respectively mounted in the plural pairs of locating windows. The parallel fan has an external single pair of power lines. Each pair of locating windows includes an inlet and an outlet for respectively enabling the fan to inhale from the inlet and discharge from the outlet.

8 Claims, 2 Drawing Sheets

PARALLEL FAN

FIELD OF THE INVENTION

The present invention relates to a fan, and more particularly to a diversified fan.

BACKGROUND OF THE INVENTION

The basic function of the industrial fan is ventilating and cooling the electrical apparatus. It normally needs one fan to be mounted in most of electrical apparatuses. The conventional cooling fan we use has a square and flat shape, and normally has a square fan frame. However, some electrical apparatuses such as the router and the hub have a specific overall shape longer, wider or narrower that of the usual ones. For a relatively bulky electrical apparatus, it will merely perform the cooling and ventilating function in the local area if we only mount one fan in the electrical apparatus. Thus, it needs to mount multiple fans in the wide side of the electrical apparatus, or else it does not reach the purpose of soundly ventilating and cooling.

FIG. 1 is a schematic view showing an architecture of conventional multiple fans assembly. The three fans 11, 12, 13 respectively are independent fan units, and respectively have fan frames 112, 122, 132 and pairs of power lines 111, 121, 131. In Addition, each fan has four screw holes 14 on the respective fan frame for being fixed tightly onto the electrical apparatus.

Presently, the assembling method of the cooling fans on the electrical apparatus is to fix the multiple conventional fan frames one by one to the electrical apparatus by means of screws one by one thus resulting in less elasticity of assembly. Moreover, it uses lots of screws for fixing onto the electrical apparatus the multiple conventional fan frames thus resulting in unnecessary increased manufacturing cost and assembling time. In addition, each fan frame has an external pair of power lines. While multiple fan frames are to be mounted in the electrical apparatus, there are many external pairs of power lines in the electrical apparatus. As known, it is troublesome to arrange these external power lines and handle the entwining external power lines in the electrical apparatus.

SUMMARY OF THE INVENTION

It is therefore an object of the present invention to overcome the above draw backs associated with the prior art fan assemblies.

It is therefore another object of the present invention to provide a parallel fan for assembling multiple fans in the same fan frame.

It is further an object of the present invention to provide an architecture for a parallel fan, in which the hardware assembling cost and assembling time are reduced by using fewer screws and less fan frames.

It is still an object of the present invention to provide a parallel fan for diminishing the vibration from multiple screws used for fixing the multiple fan units onto the electrical apparatus.

It is an additional object of the present invention to provide an assembling method of power lines for a parallel fan, in which the parallel fan has an external single pair of power lines for multiple fans because of the power lines of multiple fans being connected in parallel to one another.

According to the present invention, a parallel fan includes an integrally formed fan frame having plural pairs of locating windows, and a plurality of fans being respectively mounted in the plural pairs of locating windows.

Generally, the pair of locating windows can include an inlet and an outlet for respectively enabling said fan to inhale from the inlet and discharge from the outlet.

Certainly, the inlet and the outlet can be respectively provided on a first plane and a second plane of the fan frames.

Preferably the first plane adjoins the second plane.

Generally, the first plane and the second plane are perpendicular to each other.

Certainly, the fan can be a centrifugal fan.

Preferably the first plane and the second plane are parallel to each other.

Generally, the fan is an axIial-flow fan. Certainly, the fan can be a cross fan.

Certainly, the power lines, of the fans can be connected in parallel to one another.

According to a further aspect of the present invention, the parallel fan includes an integral fan frame having a first pair of locating windows and a second pair of locating windows, a first fan mounted in the first pair of locating windows and a second fan mounted in the second pair of locating windows.

Preferably the power lines of the first fan are parallel with those of said second fan, thereby the parallel fan has an external single pair of power lines.

BRIEF DESCRIPTION OF THE DRAWINGS

The present invention may best be understood through the following descriptions with reference to the accompanying drawings, in which.

DETAILED DESCRIPTION OF THE PREFERRED EMBODIMENTS

The present invention will now be described in more detail with reference to the following embodiment. It is to be noted that the following descriptions of the preferred embodiments of this invention are presented herein for the purpose of illustration and description only. It is not intended to be exhaustive or to be limited to the precise form disclosed.

Figure 1:
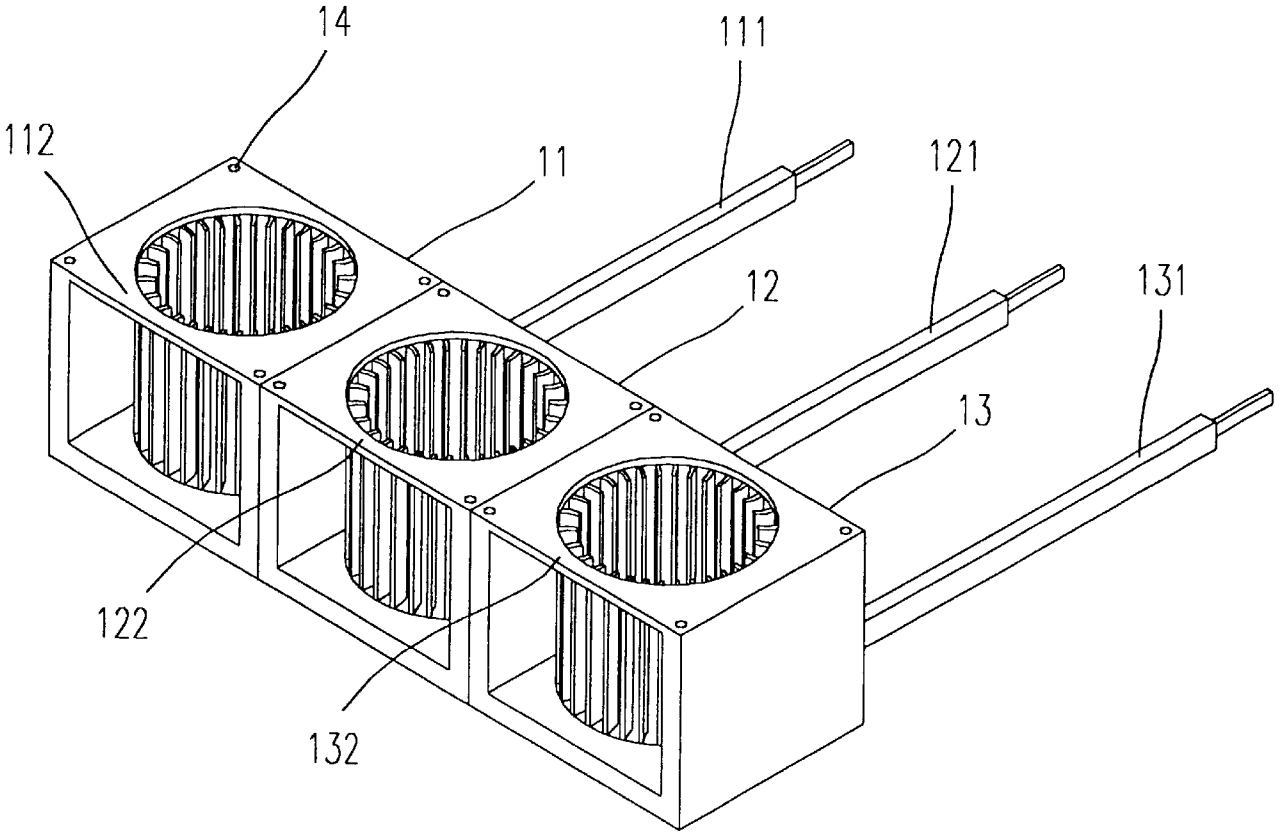
Fig. 1(PRIOR ART)
FIG. 1 is a schematic view showing an architecture of conventional multiple fan assemblies.
Figure 2:
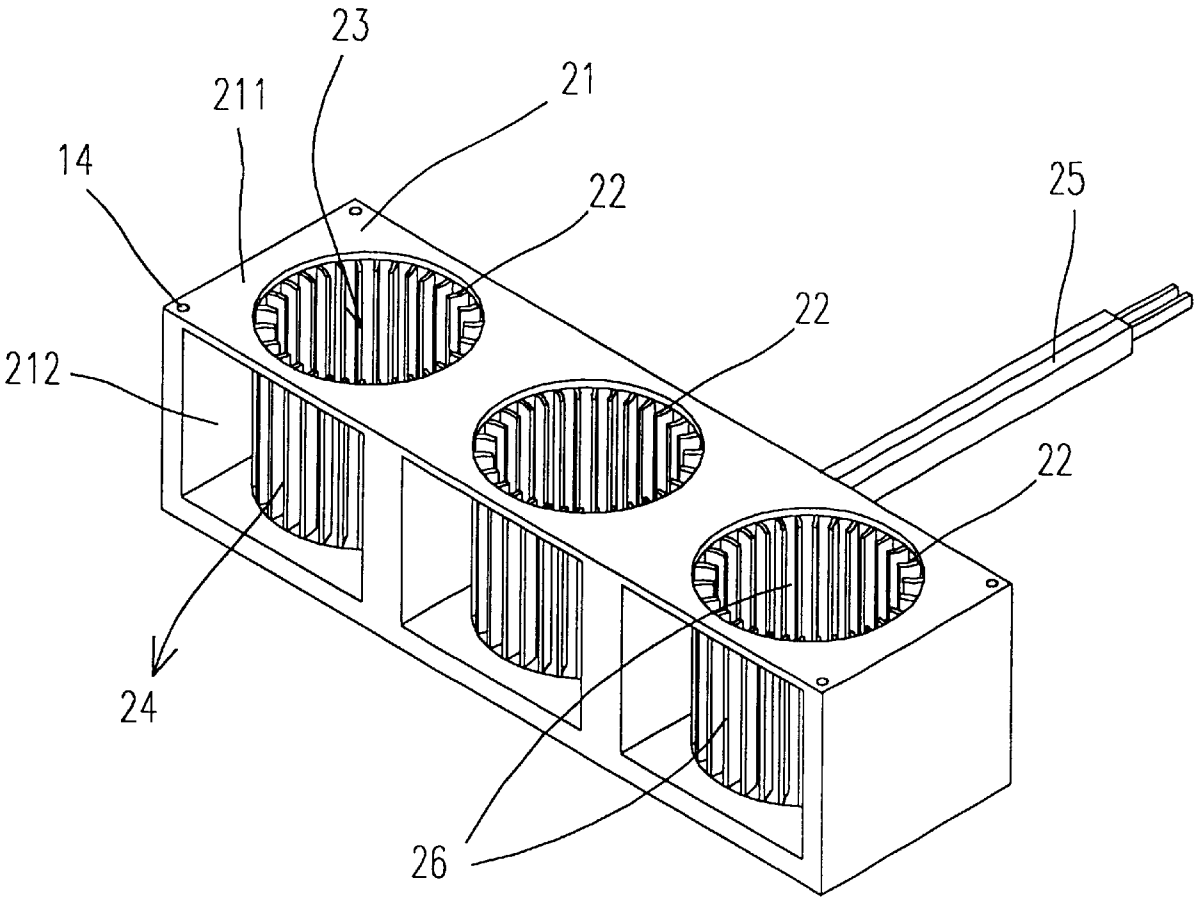
FIG. 2 is a schematic view showing a preferred embodiment architecture for a parallel fan according to the present invention.

Referring now to FIG. 2, there is shown a preferred embodiment architecture for a parallel fan according to the present invention. The parallel fan includes a fan frame 21 and a plurality of fans 22. The fan frame 21 is integrally formed, and has a plurality of locating windows 26. The plurality of fans 22 are respectively mounted in the plurality of pairs of locating windows 26.

Accordingly, each pair of locating windows 26 includes an inlet 23 and an outlet 24 for enabling the fan 22 mounted in the locating windows 26 to inhale from the inlet 23 and discharge from the outlet 24. The outlet 24 and the inlet 23 are mounted in a first plane 211 and a second plane 212 of the fan frame 21. The first plane 211 adjoins to the second plane 212, and the first plane 211 and the second plane 212 are perpendicular to each other. In this instance, the fan is a centrifugal fan.

In addition to the above-mentioned outer appearance, the outlet 24 and the inlet 23 can also be provided on two planes which are parallel with each other. In such situation, the fan can be an axial-flow fan, and can be a cross fan, too.

For the assemblage of power lines 25, the multiple pairs of power lines of the multiple fans 22 are electrically connected in parallel to one another inside of the parallel fan structure, and the parallel fan has an external single pair of power lines 25. Thus, it can avoid the normally inextricable power fines problem of the conventional multiple fans. Generally, the fan 22 includes a rotating fan and a stator.

In conclusion, the present application discloses an integrally formed parallel fan which can jointly use the structural walls of the multiple fans and can use fewer screws for fixing and assembly, so that it can minimize the fan occupying space, the fan manufacturing cost and the assembly time. Moreover, the integral formed fan, frame structure will have less vibration than the multiple fan frames assemblies have when the electrical apparatus acts and the fan performs the cooling and ventilating function. The present application also provides an improved assembling method of the multiple pairs of power lines from the multiple fan frames. The pairs of power lines inside the integrally formed fan frame structure are connected in parallel to one another according to the present invention. Thus, the parallel fan has one external pair of power lines to minimize the assemblage complexity of the external pairs of power lines and avoid the entwining problem of the external pairs of power lines.

While the invention has been described in terms of what are presently considered to be the most practical and preferred embodiments, it is to be understood that the invention need not be limited to the disclosed embodiment. On the contrary, it is intended to cover various modifications and similar arrangements included within the spirit and scope of the appended claims which are to b accorded with the broadest interpretation so as to encompass all such modifications and similar structures. Therefore, the above description and illustration should not be taken as limiting the scope of the present invention which is defined by the appended claims.

We claim:

1. A parallel fan, comprising:

an monolithic formed fan frame having plural pairs of locating windows;

a plurality of centrifugal fans being respectively mounted in said plural pairs of locating windows; and wherein said monolithic formed fan frame and each of said plurality of centrifugal fans are structured and arranged so that each of said centrifugal fans generate an equal airflow rate.

2. The fan according to claim 1, wherein each said inlet and said outlet are respectively provided on a first plane and a second plane of said fan frames.

3. The fan according to claim 2, wherein said first plane adjoins to said second plane.

4. The fan according to claim 3, wherein said first plane and second plane are perpendicular to each other.

5. The parallel fan according to claim 2, wherein said first plane and second plane are parallel with each other.

6. The fan according to claim 5, wherein said fan is an axial-flow fan.

7. The fan according to claim 5, wherein said fan is a cross fan.

8. The fan according to claim 1, wherein power lines of said fans are connected in parallel to one another.

* * * * *